US009878186B2

(12) United States Patent
Einhaus

(10) Patent No.: US 9,878,186 B2
(45) Date of Patent: Jan. 30, 2018

(54) COMPONENT FOR FITTING TO A SAFETY HARNESS

(71) Applicant: Marco Einhaus, Wessling (DE)

(72) Inventor: Sonja Einhaus, Wessling (DE)

(73) Assignee: Marco Einhaus, Wessling (DE)

( * ) Notice: Subject to any disclaimer, the term of this patent is extended or adjusted under 35 U.S.C. 154(b) by 0 days.

(21) Appl. No.: 14/901,616

(22) PCT Filed: Jun. 26, 2014

(86) PCT No.: PCT/EP2014/063543
§ 371 (c)(1),
(2) Date: Dec. 28, 2015

(87) PCT Pub. No.: WO2014/207116
PCT Pub. Date: Dec. 31, 2014

(65) Prior Publication Data

US 2016/0193487 A1 Jul. 7, 2016

(30) Foreign Application Priority Data

Jun. 26, 2013 (DE) ..... 10 2013 010 662

(51) Int. Cl.
*A62B 35/00* (2006.01)

(52) U.S. Cl.
CPC ..... *A62B 35/0031* (2013.01); *A62B 35/0006* (2013.01); *A62B 35/0025* (2013.01)

(58) Field of Classification Search
CPC ..... A62B 35/0012; A62B 35/0018; A62B 35/0031; A62B 35/0025
See application file for complete search history.

(56) References Cited

U.S. PATENT DOCUMENTS 1,775,736 A * 9/1930 Rose ..... A01G 3/08 182/6
3,757,893 A * 9/1973 Hobbs ..... A62B 35/0037 182/6

(Continued)

FOREIGN PATENT DOCUMENTS

DE 20 2011 052479 U1 2/2012
EP 1 557 198 A1 7/2005

(Continued)

OTHER PUBLICATIONS

English translations of the Abstracts of the cited Foreign Patent Documents.

*Primary Examiner* — Colleen M Chavchavadze
(74) *Attorney, Agent, or Firm* — Robert A. Blaha; Smith Tempel Blaha LLC

(57) ABSTRACT

The invention relates to a component for fitting to a safety harness for a human user, for at least partially preventing obstruction of the femoral vein of the user, said component comprising: a support structure; two leg harness pads fitted to the support structure at such a distance from one another that, when the component is fitted to the safety harness, a section of the support structure arranged between the two leg harness pads, in particular a section without a leg harness pad, at least partially prevents obstruction of the femoral vein of the user, if the user has put on the safety harness; and a detachable fastening mechanism, that is fitted or can be fitted to the support structure, for detachably fastening the component to the safety harness.

16 Claims, 5 Drawing Sheets

(56) References Cited

U.S. PATENT DOCUMENTS

| | | | | | |
|---|---|---|---|---|---|
| 4,103,758 | A * | 8/1978 | Himmelrich | A62B 35/0025 | 182/3 |
| 5,615,750 | A * | 4/1997 | Phillips | A62B 35/0031 | 182/6 |
| 6,942,630 | B2 * | 9/2005 | Behan | A61F 5/0102 | 128/875 |
| 6,962,232 | B2 * | 11/2005 | Diggle | A63B 27/00 | 182/6 |
| 6,971,476 | B2 * | 12/2005 | Wolner | A62B 35/0031 | 119/770 |
| 7,066,181 | B2 * | 6/2006 | West | A61H 3/008 | 128/869 |
| 7,490,610 | B2 * | 2/2009 | Franklin | A62B 35/0025 | 128/869 |
| 2005/0045420 | A1 | 3/2005 | Diggle | | |
| 2005/0086914 | A1 | 4/2005 | Fennelly | | |
| 2010/0038170 | A1 * | 2/2010 | Einhaus | A62B 35/0025 | 182/3 |
| 2012/0048646 | A1 * | 3/2012 | Harris, Jr. | A62B 35/0093 | 182/6 |

FOREIGN PATENT DOCUMENTS

| | | | |
|---|---|---|---|
| FR | 2 937 254 | A1 | 4/2010 |
| GB | 2489417 | A | 10/2012 |
| WO | WO 2008/080997 | A1 | 7/2008 |

* cited by examiner

COMPONENT FOR FITTING TO A SAFETY HARNESS

TECHNICAL FIELD

The invention relates to a component for being attachable to a safety harness or a tether for a human user, a safety harness, a method of manufacturing a component for being attachable to a safety harness, a method of manufacturing a safety harness and different uses.

BACKGROUND

In WO 2008/080997 A1 a safety harness for a human user is described, which comprises a recess at least one of the leg harnesses of the safety harness, which is arranged such that the femoral vein is at least partially kept free.

US 2005/0045420 A1 discloses a safety harness. In the safety harness, at least one respective cushion arranged in the groin region is provided which is arranged at least one leg harness. With the at least one cushion, the risk of injury shall be reduced, which may arise from a falling impact acting on the groin. For a better adaption to the groin region, the at least one cushion comprises at least one film hinge in the center.

FR 2 937 254 discloses a seat belt and a safety harness, respectively, which in addition comprises an inflatable trousers which is arranged between the safety harness and the person. The inflatable trousers distribute the impact of the drop into the safety harness to a larger area.

SUMMARY

There may be a need to provide a constructively easy measure for designing a safety harness or tether for a human user for at least partially keeping free the femoral veins, when the user which has put on the safety harness or tether, falls into the safety harness or hangs in it.

According to an embodiment of the invention, a component is provided which comprises a carrier structure and two leg harness pads attached at the carrier structure with such a distance to each other, that a (for example a leg harness pad-free) portion of the carrier structure which remains between the both leg harness pads, keeps the femoral vein of the user at least partially free, in a state of the component attached to the safety harness, when the user has put on the safety harness or tether, in particular when he falls into the safety harness or tether or hangs in it. The component comprises a detachable fixing mechanism which is attached or attachable to the carrier structure, for detachably fixing the component to the safety harness or tether.

According to a further embodiment of the present invention, a safety harness, in particular a hip harness or a chest and hip harness, for a human user is provided, wherein the safety harness comprises two leg harnesses for two human legs of the user and at least one component with the features described above, which is detachably attached or non-detachably fixed to at least one of the leg harnesses in the region of the pelvis of the user, and which is positioned such that at the (in particular leg harness pad-free) portion of the at least one component, the femoral vein of the user is at least partially kept free, when the user has put on the safety harness.

According to another embodiment of the present invention, a method of manufacturing a component for being attachable to a safety harness for a human user for at least partially keeping free the femoral vein of the user is provided, wherein in the method a carrier structure is provided, two (in particular cushion-shaped) leg harness pads are attached at the carrier structure with such a distance to each other, that a (in particular leg harness pad-free) portion of the carrier structure which remains between the both leg harness pads, in a state of the component attached to the safety harness, at least partially keeps free the femoral vein of the user, when the user has put on the safety harness, and a detachable fixing mechanism is attached to the carrier structure for detachably fixing the component to the safety harness or a detachable fixing mechanism attachable to the carrier structure is provided.

According to yet another embodiment of the present invention, a method of manufacturing a safety harness for a human user is provided, wherein in the method at least one component is manufactured by a method with the features described above, two leg harnesses for two human legs of the user are provided, the at least one component is detachably attached or non-detachably fixed to at least one of the leg harnesses in the region of the pelvis of the user, such that at the (in particular leg harness pad-free) portion of the at least one component, the femoral vein of the user is at least partially kept free, when the user has put on the safety harness.

According to yet another embodiment of the present invention, at least one component with the features described above is used for retrofitting a present safety harness with two leg harnesses for two human legs of a user, such that, in a retrofitted state at the particularly leg harness pad-free portion of the at least one component, the femoral vein (vena femoralis) of the user is at least partially kept free, when the user wears the safety harness which is retrofitted with the at least one component.

According to yet another embodiment of the present invention, at least one component with the features described above is used for work safety, for construction, for installation work, for medical engineering applications, for climbing, for sport climbing, for parachutes, for rescue expeditions, for silo service lifts, for salvage work or in space technology.

The design of the component according to an embodiment of the present invention distinguishes by the fact that the leg harness pads comprise a (particularly temporary, for example existing only under pressure load, or permanent, for example existing always and also in a force-free state) recess in a detachable carrier structure, which is arranged to at least partially keep free the femoral vein (vena femoralis).

According to an exemplary embodiment of the invention, the component is formed as a part which is at least partially separated from the safety harness, which, by means of fixing mechanism which is attached or attachable to the carrier structure, can be detachably attached to an almost arbitrary safety harness and tether for human users. This allows to equip already present safety harnesses and tethers with the inventive component later on or in addition. This has the advantage that safety harnesses and tethers can be cost-efficiently retrofitted with at least one component for at least partially recessing the femoral vein, and no completely new safety harness or tether has to be manufactured. This improves the protection of users of conventional harnesses from an orthostatic shock which often ends deadly when falling into a harness, and increases with low effort the operational safety of safety harnesses and tethers. Furthermore, due to manufacturing technique related reasons, it has turned out as highly advantageous to be able to manufacture the femoral vein protection separated from the safety harness. Thereby it is also possible, for example by sliding the component along a leg harness of the safety harness, to make the safety harness which is equipped with the component adaptable to anatomical peculiarities of a respective user and/or with respect to a desired application.

In the following, additional exemplary embodiments of the component, the safety harness, the methods and the use will be described.

According to an embodiment, the fixing mechanism is firmly fixed to the carrier structure and is therefore non-detachably attached to it. This has the advantage, that a user only has to handle one integrally component.

Alternatively, it is also possible to provide the fixing mechanism separated and separable from the carrier structure, respectively, i.e. to form the component as multiple pieces. For example, the fixing mechanism may be formed as a separated loop which, under tension, is guided around the carrier structure and one leg harness, to fix the component to the safety harness. It is also within the scope of the invention, that the fixing mechanism is provided at the safety harness and attached to it, respectively, and is then attached to the carrier structure when forming the detachable fixing.

According to an exemplary embodiment, the carrier structure in the region of the portion may at least partially be covered with an in particular flexible material (for example with a further leg harness pad) which, at least under pressure load (in particular by the user, when the user has put on the safety harness, further in particular when he experiences a falling with put on safety harness) forms a recess for at least partially keeping free the femoral vein. According to this embodiment, the portion is thus not leg harness pad-free.

According to an exemplary embodiment, the flexible material can be softer than the material of the leg harness pads, such that the flexible material under pressure load, in particular exclusively under pressure load, keeps free the recess for at least partially keeping free the femoral vein. According to such a design, of which an example is shown in FIG. 6, the portion between the both leg harness pads is thus occupied with a compliant material, which complies already due to small forces and thereby keeps free the femoral vein.

According to an exemplary embodiment, the particularly flexible material may be formed such that, even when there is no pressure load between the leg harness pads, it keeps free the recess for at least partially keeping free the femoral vein. Thus, according to this embodiment, material is indeed located on the carrier structure, but this material has a smaller thickness as adjoining regions of the leg harness pads.

Optionally, the portion between the both leg harness pads can be leg harness pad-free, that is, comprises no leg harness pads. Alternatively to this, it is possible to provide the central recess with some material which, for example, can be thinner and/or softer than adjacent material of the leg harness pads, but still keeps free the femoral vein.

Apart from detachable, the component (and its pad, respectively), can be slidable and/or adjustable. The slidability and/or adjustablility can also be enabled when the component is mounted to the safety harness.

According to an exemplary embodiment, the carrier structure can be an elastic and/or flexible carrier strip. The carrier strip can be flexible or bendable and adapt itself to the anatomy of a user, without thereby limiting its capability to keep free the femoral vein.

According to an exemplary embodiment, the carrier structure can be made of plastic, in particular of a polyethylene-polypropylene mixture. In this way, the carrier structure can be manufactured cost-efficiently. The configuration of the carrier structure as plastic strips ensures a high robustness and a long life duration, as well as a low weight of the component.

According to another exemplary embodiment, the carrier structure can be formed as a textile stiff band (for example a harness band).

According to an exemplary embodiment, the carrier structure can have a first main surface, at which the both leg harness pads project beyond the carrier structure, and a second main surface facing the first main surface, at which the detachable fixing mechanism is attached, such that, when the second main surface abuts against a leg harness of the safety harness, the leg harness is detachably fixingly enclosed by the fixing mechanism. The second main surface may be formed planely or evenly and thus may abut against the leg harness of the safety harness over its whole surface.

According to an exemplary embodiment, at least in the (particularly leg harness pad-free) portion, the carrier structure may have a width in a range between 30 mm and 60 mm, in particular between 40 mm and 50 mm. This width is high enough to promote the function of keeping free the femoral vein, when the user has put on the safety harness and experiences a fall. At the same time, this width is small enough to keep the component compact and lightweight.

According to an exemplary embodiment, the particularly leg harness pad-free portion of the carrier structure may have a length in a distance direction which is in a range between 50 mm and 150 mm, in particular in a range between 70 mm and 90 mm. By providing a recess, an indentation and a locally softer (with respect to the leg harness pads) region, respectively, of the mentioned dimensions, a keeping free of the femoral vein can be achieved.

According to an exemplary embodiment, the carrier structure in the region of the particularly leg harness pad-free portion can be locally narrowed with respect to adjoining portions in a width direction, at which adjoining portions the leg harness pads are attached. Thereby, a material-saving and material-poor design can be achieved, which, in the region of the local narrowing, comprises a high degree of flexibility and thus adaptability to anatomical peculiarities of a user. Adjoining this locally narrowed region, the both leg harness pads are located, which distribute an applied load over a larger surface region and thus convey a pleasant wearing feeling.

According to an exemplary embodiment, the both leg harness pads can be formed wedge-shaped, such that their front faces are facing each other under the formation of the leg harness pad free portion in between. The wedge-shaped forming of the both leg harness pads may be realized such that the height of the leg harness pads increases in a direction towards the portion arranged between the both leg harness pads with a constant or varying gradient and then decreases with a larger gradient with respect to the magnitude and ends at this location in the particularly leg harness pad-free portion. This wedge-shaped forming of the both leg harness pads ensures a pleasant wearing comfort and in addition allows especially reliably a keeping free of the femoral vein in a sudden falling event.

According to an exemplary embodiment, the both leg harness pads can be formed of an elastic and/or flexible material, in particular of gel and/or foam, wherein further in particular one of the both leg harness pads is formed of gel and the other of the both leg harness pads is formed of foam. Designing a leg harness pad made of gel has the advantage of an especially good adaptability to the body of a user without (due to the extensive incompressibility of gels) changing the entire volume of a leg harness pad. Designing a leg harness pad made of foam on the other hand enables to implement a targeted damping function and compression function under load, respectively, due to the compressibility of the foam.

According to an exemplary embodiment, the both leg harness pads may be formed as multilayered layer structure. Its layers may become softer, the more they are distanced to the carrier structure. With a realization of a leg harness pad made of multiple layers of the same or different materials (such as foam), it is possible to form the leg harness pad and its core coated with textile, respectively, of multiple regions which have the same of different dimensions and thus to achieve a locally varying thickness and locally varying firmness.

Alternatively, the both leg harness pads may also be formed integrally, for example as injection part or foamed part. This enables a cost-efficient manufacturing.

According to an exemplary embodiment, the fixing mechanism may comprise at least two pairs of fixing flaps, wherein each pair of fixing flaps comprises fixing elements which cooperate for forming a detachable connection. Descriptively, the flaps may be guided entirely or partially around the leg harness and then detachably attached again to the leg harness. Thereby, a component is provided which is uncomplicated and intuitively manageable for a user, which at the same time is reliably fixable to the safety harness. Alternatively or in addition to the fixing flaps, fixing loops may be provided as well.

According to an exemplary embodiment, the fixing elements may be selected from a group consisting of hook and pile fastener elements, magnetic elements, adhesive elements and mechanical locking elements. Such fixing elements are manufacturably cost-efficient and nevertheless enable an error-robust fixing of the component to a safety harness.

According to an exemplary embodiment, the component may comprise a surrounding structure which ring-shapedly surrounds the carrier structure and to which the both leg harness pads and the fixing mechanism are fixed. Such a surrounding structure or surrounding may for example be made of textile material, plastic or rubber and may cover possible sharp edges of the carrier structure, to increase the operational safety. Such a surrounding structure may also protect the carrier structure from abrasion due to mechanical influences.

According to an exemplary embodiment, the surrounding structure may be made of cloth which is sewed or adhered to at least one of the carrier structure, the leg harness pads and the fixing mechanism. This allows a cost-efficient manufacture of the surrounding structure.

According to an exemplary embodiment, a length of the component may be between 20 cm and 40 cm, in particular between 25 cm and 35 cm. Thereby, the component can be formed compact and lightweight and nevertheless comprise a large body contact surface, to distribute the forces occurring in a drop over a sufficiently large surface region of the body of the user, without occurring of painful force peaks.

According to an alternative embodiment, a surrounding structure can also be omitted. Thereby, the component may be manufactured especially cost-efficient and lightweight.

According to an exemplary embodiment, the leg harness pads may be formed cushion-shaped. As a consequence, the leg harness pads may exhibit a certain compliance under mechanical load and therefore provide a mechanical damping function. The cushion-shaped leg harness pads may in addition be in force distributing operative contact with the body of the user over a two-dimensional surface region.

According to an exemplary embodiment, the safety harness may be formed to maintain a blood flow through the femoral vein even in the case that the user has put on the safety harness and falls into the safety harness. Thereby, the user can be effectively protected from an orthostatic shock which may be life-threatening under circumstances when he experiences a fall.

In the following, exemplary embodiments of the present invention will be described in detail with reference to the following figures.

DETAILED DESCRIPTION OF ILLUSTRATED EMBODIMENTS

Figure 1:
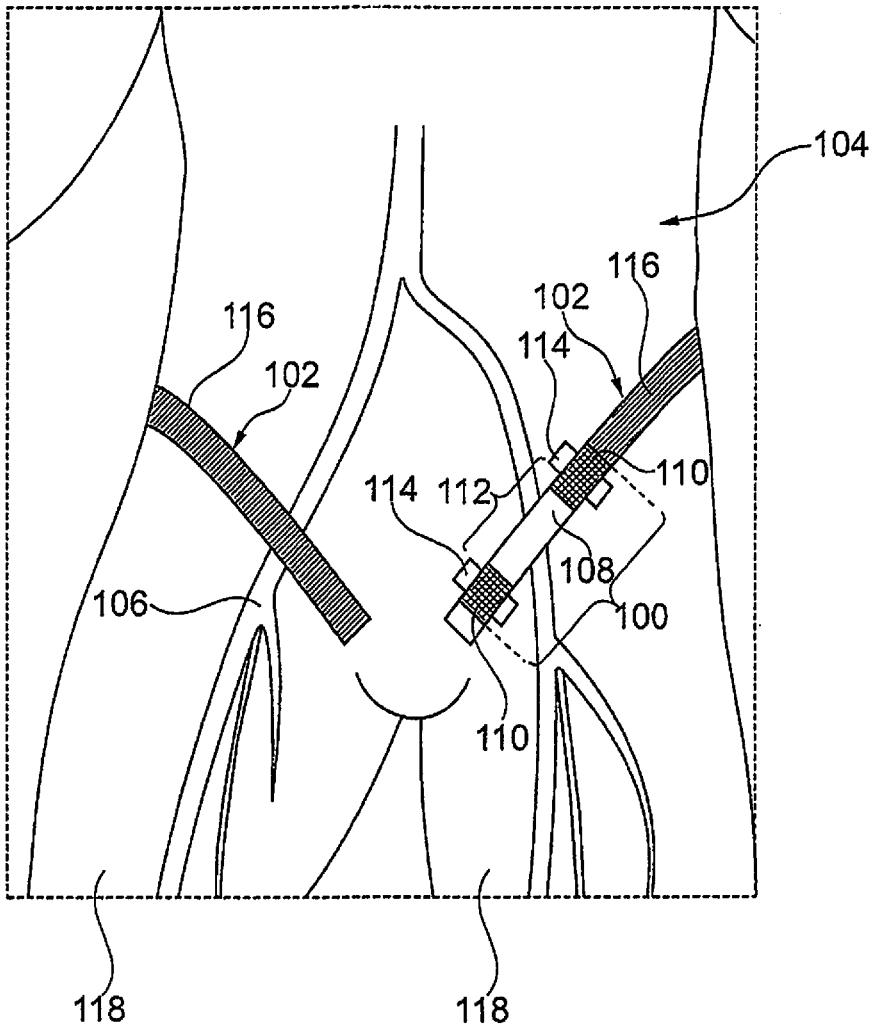
FIG. 1 shows a safety harness according to an embodiment of the present invention.

Same or similar components in different figures are provided with the same reference numerals.

FIG. 1 shows a safety harness 102 according to an embodiment of the present invention.

The safety harness 102 can be formed as hip harness as shown or alternatively as chest harness and hip harness for a human user 104. The safety harness 102 comprises two leg harnesses 116 for two human legs 118 of the user 104. The safety harness 102 in the shown embodiment further comprises a component 100 which is detachably attached to one of the leg harnesses 116 in the region of the pelvis of the user 104. In other words, the component 100 can be removed from the safety harness 102 or temporarily fixed to it due to its detachable fixability. The component 100 is further configured such that a user 104 can slide the component 100 along the leg harness 116, to adapt it to the anatomical proportions of the user 104 and to adjust it user definedly, respectively.

Although this is not shown in the Figure, it is also possible to fix the component 100 non-detachably to the leg harness 116. This can be carried out for example by sewing, riveting or durably and non-detachably adhering, respectively. In such a case, the component 100 can firstly be provisionally detachably fixed and prefixed to the safety harness 102, respectively, by a detachable fixing mechanism 114 (for example a hook and pile fastener). Afterwards, the component 100 which is such detachably fixed to the safety harness 102 can be slid along the safety harness 102 to a desired position (which in particular shall ensure the keeping free of the femoral vein 106) for purposes of adjustment, and then be fixed durably and non-detachably (without destruction) to the safety harness 102, for example by sewing or adhering.

In this way, an equipping and retrofitting of a safety harness 102 may be carried out, respectively, to equip the safety harness 102 with a protection mechanism against an undesired press shutting of the femoral vein 106 of the user 104 when wearing the safety harness 102.

Both in the case of the detachably attaching, and in the case of the non-detachably fixing, the component 100 can positioned at the safety harness 102 such that at a, in the shown embodiment leg harness pad-free, portion 112 of the component 100 between two leg harness pads 110, the femoral vein 106 of the user 104 is kept free, when the user 104 has put on the safety harness. The safety harness 102 is in particular formed to maintain a blood flow through the femoral vein 106 even in the case when the user 104 has put on the safety harness 102 and even in the case when the user 104 falls into the safety harness 102.

The component 100 is also formed for being attachable to the safety harness 102 for keeping free the femoral vein 106 of the user 104. The component 100 comprises a carrier structure 108 and has the two leg harness pads 110 which are attached to the carrier structure 108 in such a distance, that the leg harness pad-free portion 112 of the carrier structure 108 which remains between the both leg harness pads 110, in the state of the component 100 attached to the safety harness 102, keeps free the femoral vein 106 of the user 104, when the user 104 has put on the safety harness 102. Further, the detachable fixing mechanism 114 for detachably fixing the component 100 to the safety harness 102 is attached to the carrier structure 108.

Figure 2:
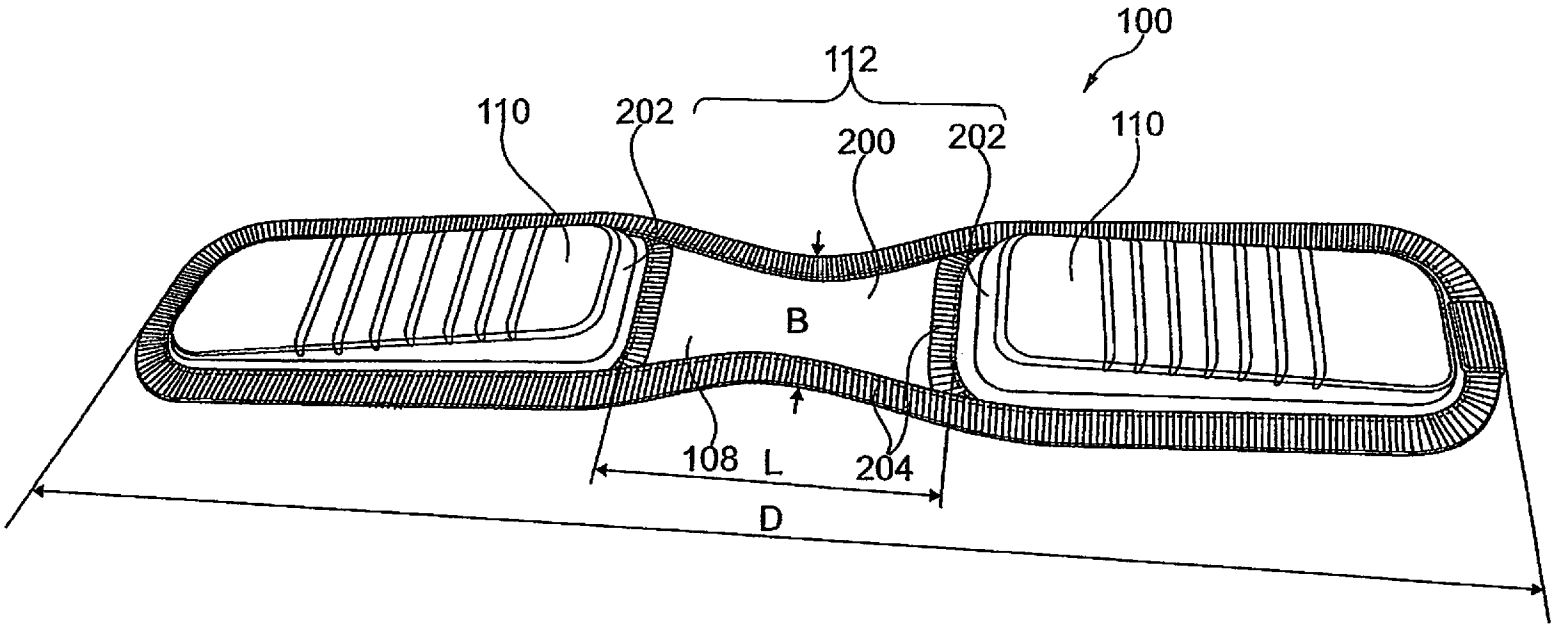
FIG. 2 shows a component for being attachable to a safety harness or a tether according to an embodiment of the present invention.

FIG. 2 shows a plan view of a component 100 for being attachable to a safety harness or tether 102 (not shown in FIG. 2, for example to the safety harness 102 according to FIG. 1) according to an embodiment of the present invention.

Figure 3:
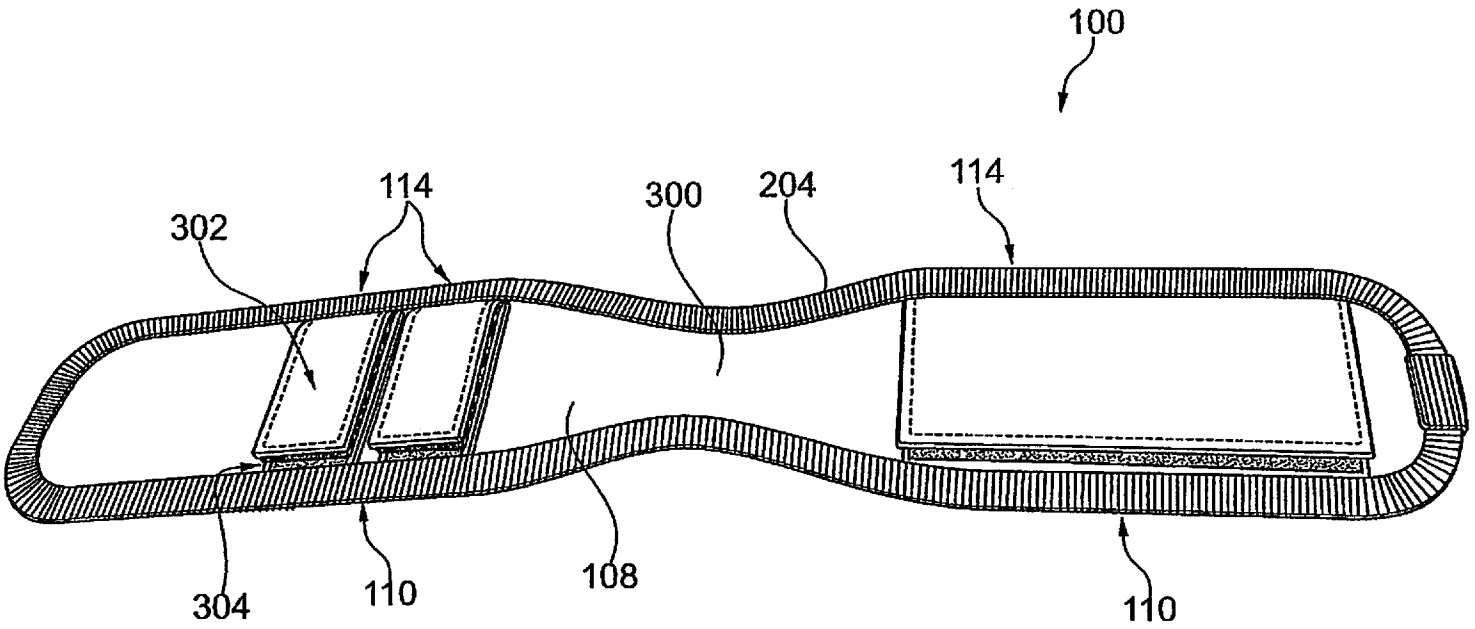
FIG. 3 shows another view of the component according to FIG. 2.
Figure 4:
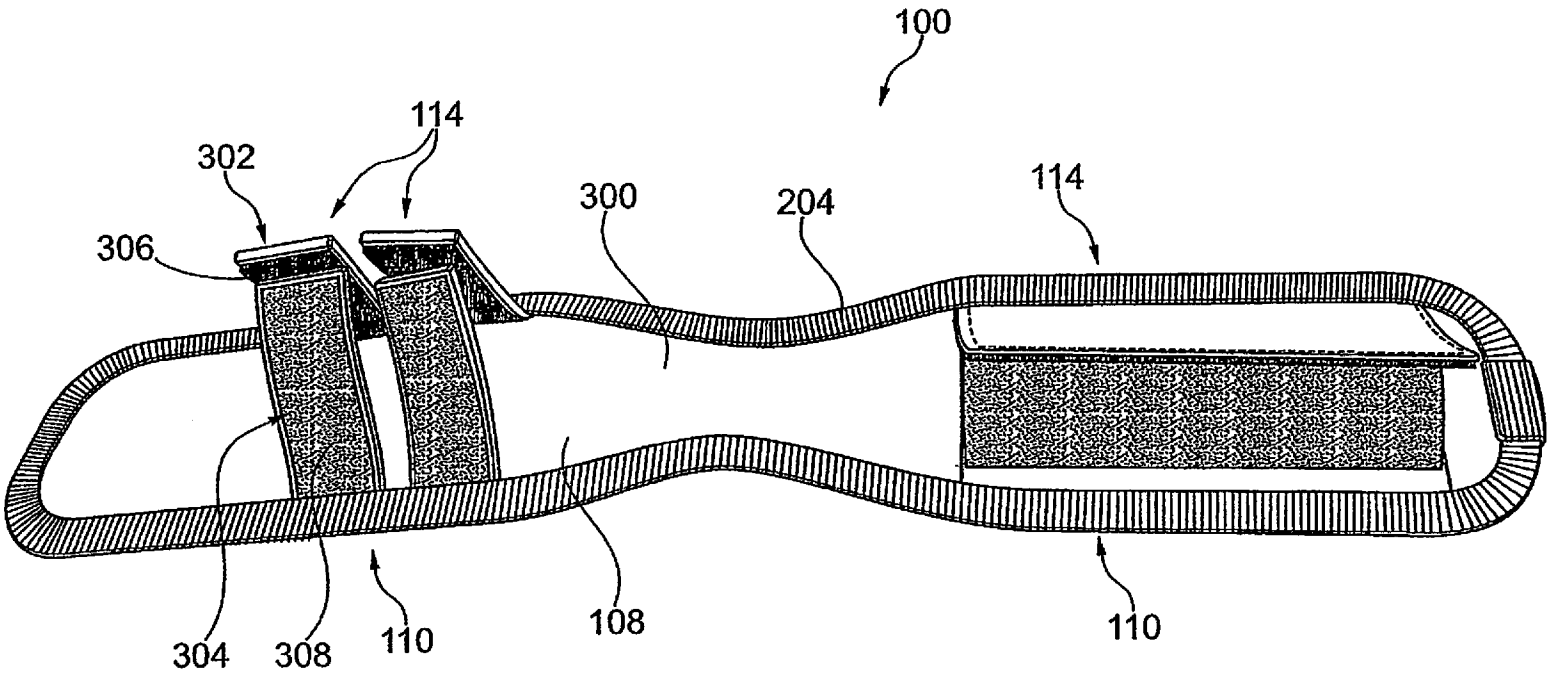
FIG. 4 shows a yet further view of the component according to FIG. 2.

The carrier structure 108 in the shown embodiment is an elastic and flexible carrier strip made of plastic, respectively, for example made of a polyethylene-polypropylene mixture. The carrier structure 108 has a first main surface 200, at which the both cushion-shaped leg harness pads 110 project beyond the carrier structure 108. At a second main surface 300 (as can be seen in FIG. 3 and FIG. 4 in detail) which is facing the first main surface 200, the detachable fixing mechanism 114 (can also be seen in FIGS. 3 and 4 in detail) is attached such that, when the second main surface 300 contactingly abuts against a leg harness 116 of the safety harness 102, the leg harness 116 is detachably fixingly enclosed by the fixing mechanism 114. In the present portion 112, which is leg harness pad-free, the carrier structure 108 has a width B in a range between 30 mm and 60 mm. The portion 112 of the carrier structure 108 has a length L in a distance direction between the leg harness pads 110, which is in a range between 50 mm and 150 mm. An entire length D of the component 100 (along a—in a state of the component 100 mounted to the safety harness 106—extension direction of the leg harness 116) is between 20 cm and 40 cm.

The carrier structure 108 is locally narrowed in a region of the portion 112 (i.e. comprises a constriction) in the width direction with respect to adjoining portions, at which adjoining portions the leg harness pads 110 are attached. The both leg harness pads 110 are formed wedge-shaped (such a wedge-shape can be seen especially good in FIG. 5), such that their front faces 202 are facing each other under formation of the leg harness pad-free portion 112 in between. The both leg harness pads 110 are formed of an elastic or flexible material, here foam.

The component 100 further comprises a surrounding structure 204, which ring-shapedly and fully circumferentially encloses and surrounds the carrier structure 108, and to which the both leg harness pads 110 and the fixing mechanism 114 are fixed. The surrounding structure 204 can be made of textile cloth which is sewed or adhered to the carrier structure 108 and the leg harness pads 110.

FIG. 3 shows a sub-view of the component 100 according to FIG. 2, according to which the fixing mechanism 114 (however without leg harness 116 arranged between) is brought in a fastening state. When a leg harness 116 not shown in FIG. 3 is attached between the carrier structure 108 and cooperating fixing flaps 302, 304 (with hook and pile fastener function) of the fixing structure 114, and the fixing flaps 302, 304 are brought in the shown fastening state, the component 100 is detachably fixed to the safety harness 102. FIG. 4 shows another sub-view of the component 100 according to FIG. 2 and FIG. 3, at which the fixing flaps 302, 304 are brought into an opening state in which the component 100 can be detached and removed from the leg harness 116 not shown in FIG. 4, respectively.

The fixing mechanism 114 of the component 100 comprises three pairs of fixing flaps 302, 304 in the shown example, wherein each pair of fixing flaps 302, 304 comprises fixing elements 306, 308 which cooperate for forming a detachable connection. The fixing elements 306, 308 may be formed as hook and pile fastener elements with hooks and loops, respectively.

Figure 5:
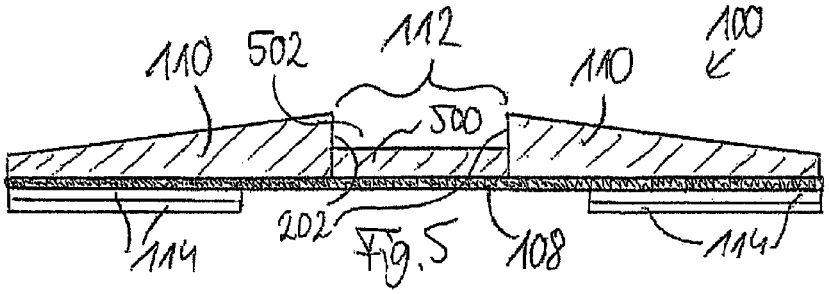
FIG. 5 shows a cross-sectional view of a component according to another exemplary embodiment of the invention.

FIG. 5 shows a cross-sectional view of a component 100 according to another exemplary embodiment of the invention. According to FIG. 5, also in the portion 112 a leg harness pad 500 is provided which is made of flexible material, which provides a smaller thickness, perpendicular to the extension direction of the carrier structure 108, than the both leg harness pads 110 in the region in which they adjoin the leg harness pad 500. Thereby, in the region of the leg harness pad 500, a recess 502 is formed which serves for keeping free the femoral vein. The leg harness pad 500 may be made of the same material as the leg harness pads 110. It is actually possible to integrally form the leg harness pad 500 and the leg harness pads 110, in particular of a cohering piece of foam.

According to FIG. 5, the fixing mechanism 114 is formed by two pairs of cooperating hook and pile fastener elements.

Figure 6:
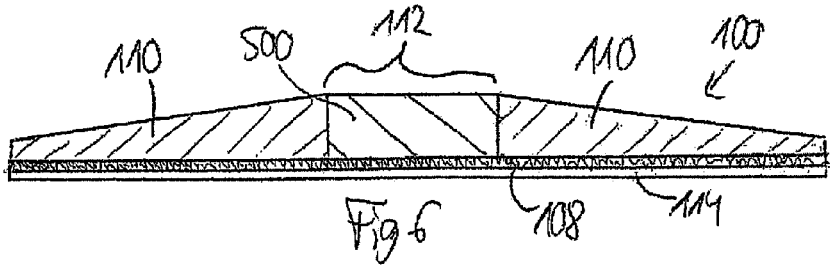
FIG. 6 shows a cross-sectional view of a component according to a yet another exemplary embodiment of the invention.

FIG. 6 shows a cross-sectional view of a component 100 according to a yet further exemplary embodiment of the invention.

In contrast to the component 100 according to FIG. 5, in the component 100 according to FIG. 6, the leg harness pad 500 formed of flexible material is formed between the leg harness pads 110, such that its height in a region directly adjoining the leg harness pads 110 is identical to the heights of the both leg harness pads 110 there, such that a mechanical continuous structure with a steady, stepless height profile is provided. Due to the fact that according to FIG. 6, the leg harness pad 500 is made of a softer material as the leg harness pads 110, which material complies already due to a low mechanical load, the leg harness pad 500 also serves for keeping free the femoral vein, in particular under mechanical load (like in the case of a drop or fall).

According to FIG. 6, the fixing mechanism 114 is formed by an adhesive layer which is detachably and reversibly connectable to a leg harness 116.

Figure 7:
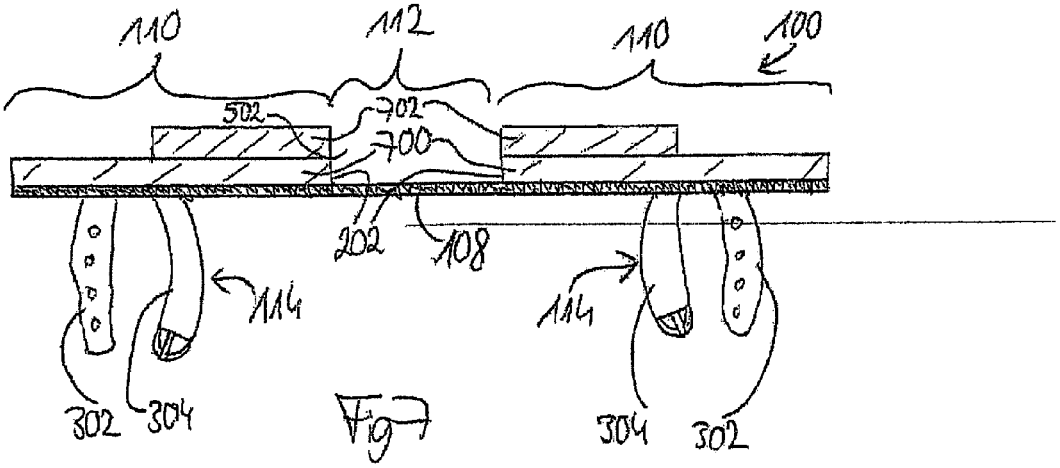
FIG. 7 shows a cross-sectional view of a component according to a further exemplary embodiment of the invention.

FIG. 7 shows a cross-sectional view of a component 100 according to a further exemplary embodiment of the invention.

According to FIG. 7, the both leg harness pads 110 are formed as a multilayered layer structure, wherein their layers become softer, the more they are distanced to the carrier structure 108. In other words, a respective first layer 700 which is attached directly on the carrier structure 108, comprises a larger extension in a longitudinal direction of the carrier structure 108 and a higher hardness than a respective second layer 702, which is arranged on the respective first layer 700 and thus with a distance to the carrier structure 108. By a selection of the hardnesses and the dimensions of the single layers 700, 702, the mechanical properties of the leg harness pads 100 can be adjusted fitting to a respective application.

According to FIG. 7, the fixing mechanism 114 is formed by two respectively cooperating pairs of fixing flaps 302, 304. The fixing of the fixing flaps 302, 304 to each other is carried out as in a belt.

Supplementary, it should be noted that the term "comprising" does not exclude other elements or steps and the "a" or "an" does not exclude a plurality. Further it should be noted, that features or steps described with reference to one of the above embodiments can also be used in combination with other features or steps of other embodiments described above. Reference signs in the claims shall not be construed as limiting the scope of the claims.

LIST OF REFERENCE SIGNS

100 component
102 safety harness or tether
104 human body
106 femoral vein (vena femoralis)
108 carrier structure
110 leg harness pad
112 leg harness pad-free portion
114 detachable fixing mechanism
116 leg harness
118 human leg
200 first main surface
202 front face
204 surrounding structure
300 second main surface
302, 304 pair of fixing flaps
306, 308 fixing elements
(B) width
(L) length
(D) length of the component

The invention claimed is:

1. A component, comprising:

a carrier structure;

two leg harness pads attached to the carrier structure with such a distance to each other, that a leg harness pad-free portion of the carrier structure, which remains between the two leg harness pads is configured to keep a femoral vein of a user at least partially free, in a state of the component attached to a safety harness, when the user has put on the safety harness; and a detachable fixing mechanism which is attached or attachable to the carrier structure, for detachably fixing the component to the safety harness wherein the carrier structure in the region of the leg-harness pad free portion is at least partially covered with a flexible material which at least under a pressure load forms a recess for at least partially keeping free the femoral vein.

2. The component according to claim 1, wherein the carrier structure is a carrier band.

3. The component according to claim 1, wherein the carrier structure is made from one of a polyethylene-polypropylene mixture.

4. The component according to claim 1, wherein the carrier structure has a first main surface at which the leg harness pads project beyond the carrier structure, and a second main surface formed opposite with respect to the first main surface, at which the detachable fixing mechanism is attached, such that, when the second main surface abuts against a leg harness of the safety harness, the leg harness is detachably fixingly enclosed by the fixing mechanism.

5. The component according claim 1, wherein at least in the leg harness pad-free portion, the carrier structure has a width in a first direction in a range between 30 mm and 60 mm.

6. The component according to claim 5, wherein the-leg harness pad-free portion of the carrier structure has a length in a second direction different from the first direction in a range between 50 mm and 150 mm.

7. The component according to claim 1, wherein the carrier structure in a region of the leg harness pad-free portion, is locally narrowed in a width direction with respect to adjoining portions, at which adjoining portions the leg harness pads are attached.

8. The component according to claim 1, wherein the leg harness pads are formed wedge-shaped, such that respective faces of the leg harness pads face each other with the leg harness pad-free portion between.

9. The component according to claim 1, wherein the leg harness pads are made of an elastic material;

wherein at least one of the leg harness pads is made from at least one of a gel and foam.

10. The component according to claim 1, wherein the leg harness pads are formed as a multilayered layer structure with layers which become softer as the layers are further distanced to the carrier structure.

11. The component according to claim 1, further comprising:

a surrounding structure which ring-shapedly surrounds the carrier structure, and to which the leg harness pads and the fixing mechanism are fixed, wherein the surrounding structure is made of cloth.

12. The component according to claim 1, wherein a length of the component is between 20 cm and 40 cm.

13. The component according to claim 1, wherein the leg harness pads include an inclined surface.

14. The component according to claim 1, wherein the flexible material is softer than the material of the leg harness pads, such that the flexible material, under pressure load keeps free the recess for at least partially keeping free the femoral vein.

15. The component according to claim 1, wherein the flexible material is formed such that, even without a pressure load between the leg harness pads, the component keeps free the recess for at least partially keeping free the femoral vein.

16. The component according to claim 1, wherein the detachable fixing mechanism comprises elements which cooperate for forming a detachable connection, the elements which cooperate being selected from a group consisting of hook and pile fastener elements, magnetic elements, adhesive elements and mechanical locking elements.

* * * * *